US007249906B2

(12) United States Patent
Kessler et al.

(10) Patent No.: US 7,249,906 B2
(45) Date of Patent: Jul. 31, 2007

(54) CONTAINER FOR COSMETIC PRODUCTS

(75) Inventors: Richard D Kessler, Northport, NY (US); Paul Abbatepaolo, St. James, NY (US)

(73) Assignee: Augros Cosmetic Packaging, Colombes (FR)

( * ) Notice: Subject to any disclaimer, the term of this patent is extended or adjusted under 35 U.S.C. 154(b) by 342 days.

(21) Appl. No.: 10/848,164

(22) Filed: May 19, 2004

(65) Prior Publication Data

US 2005/0260026 A1 Nov. 24, 2005

(51) Int. Cl.
*A46B 11/00* (2006.01)
*B65D 23/12* (2006.01)

(52) U.S. Cl. ..... 401/125; 401/123; 401/124; 215/390; 215/391

(58) Field of Classification Search ..... 403/123–125; 215/383, 390, 385, 391, 44, 329, 228, 212; 220/288; 132/317
See application file for complete search history.

(56) References Cited

U.S. PATENT DOCUMENTS 812,257 A * 2/1906 Booth ..... 215/302
2,920,779 A * 1/1960 Armitage ..... 215/391
3,589,983 A * 6/1971 Holderith ..... 435/288.2
4,095,716 A * 6/1978 Meany ..... 215/391
5,669,400 A 9/1997 Sheffler et al.
6,022,162 A * 2/2000 Aumuller ..... 401/124
6,298,863 B1 * 10/2001 Byun ..... 132/294

* cited by examiner

*Primary Examiner*—David J. Walczak
(74) *Attorney, Agent, or Firm*—Manelli Denison & Selter PLLC; Edward J. Stemberger

(57) ABSTRACT

Container for receiving an element forming spatula having one end provided with a part in relief, the container including:

a stopper having a peripheral skirt having a screwing surface and a lower end;

a bottom wall;

a side wall having a first end opposite the bottom wall, an outer face, and having a slot for housing in a removable manner the element forming spatula;

a neck located at the first end of the side wall, including a screwing surface in relief for cooperating with the screwing surface of the skirt for closing the neck by screwing, the part in relief of the element forming spatula cooperating with the screwing surface in relief of the neck for closing the stopper.

12 Claims, 5 Drawing Sheets

CONTAINER FOR COSMETIC PRODUCTS

The present invention relates to a container intended to contain a substance or a product of viscous or powdery type, for example but not exclusively, in the cosmetics domain, like cosmetic creams or powders.

BACKGROUND OF THE INVENTION

More precisely, the invention relates to a container presenting a bottom wall, a side wall and a neck located at the end of the side wall opposite said bottom, liable to be closed by a stopper including a peripheral skirt surrounding the neck, said neck including a screwing surface in relief capable of cooperating with a screwing surface of said skirt to allow the closure by screwing of said stopper.

Such containers are already known presenting, for esthetic reasons, a circular or non-circular neck. Such containers are capable of being closed by stoppers with a corresponding circular or non-circular shape.

When the users wish to remove then apply the product contained in the container, they must generally use their fingers which is not very practical and particularly not hygienic.

For example, in the case where the container contains a very costly cosmetic product or in the case where the container contains only a small amount of product or again in the case where a very small amount of product is required, it is desirable to remove just the right quantity of product to be applied.

It can be easily understood that the use of the fingers does not easily allow the required quantity or amount to be chosen in all cases where this is necessary.

Moreover, using the fingers to locally apply a cosmetic product is neither practical nor accurate.

In addition, it is not very hygienic to use the fingers to extract the cosmetic product as microbes or bacteria present on the fingers are liable to contaminate the product remaining in the container.

It is an object of the present invention to provide a container substantially free from the disadvantages mentioned above.

SUMMARY OF THE INVENTION

This end is achieved by the fact that said side wall presents means for housing in a removal manner an element forming spatula including at one of its ends a part in relief which is also capable of cooperating with the screwing surface in relief of the neck to allow the closure of the stopper.

It can be understood therefore that the use of an element forming spatula housable in the container allows, firstly, the removal of the required quantity of product and, secondly, prevents the contamination of the product contained in the container and, thirdly, allows the product to be accurately applied.

The contamination of the product is avoided, on the one hand, thanks to the use of an element forming spatula as tool instead of directly using the fingers to remove then apply the product and, on the other hand, by stowing the element forming spatula in the side wall of the container.

In addition, the cooperation of the part in relief of the element forming spatula and the screwing surface in relief of the neck of the container contributes, on the one hand, to the retention of the element forming spatula with the container when the stopper is in screwed position and, on the other hand, to the integration of the element forming spatula in the container when said element is in housed position.

Advantageously, the container also includes a peripheral collar presenting an upper face in such a manner that in screwed position the lower end of the skirt of the stopper bears on the upper face of said collar.

Advantageously, it also includes stop means allowing the positioning of said element in relation to said side wall.

Preferably, the element forming spatula includes a catch capable of cooperating with the upper face of the collar to allow the positioning of the element forming spatula.

It can be understood that thanks to the catch, the element forming spatula can be correctly positioned in the side wall of the container and is also capable of being retained in translation when it is not used.

Advantageously, the means for housing the element forming spatula include a slot formed in the outer face of the side wall of the container.

In order to be able to house the spatula element, the dimensions of the slot are preferentially such that, when the element forming spatula is housed in the slot, a face of said element forming spatula is flush with the outer face of the side wall of the container.

It is therefore understood that when the element forming spatula is housed in the container, the outer face of the side wall of the container presents practically no discontinuities, in particular at the location of the screwing surface in order not to prevent the closure of the stopper but also, globally, so that the presence of the element forming spatula is not very visible.

According to another embodiment, the means for housing the element forming spatula include a channel formed in the side wall of the container.

This channel plays the role of a sheath into which the user inserts the element forming spatula when it is not in use. This allows the spatula to be kept in a clean place surrounding almost completely the element forming spatula in order to avoid all risks of contamination of the element forming spatula and indirectly of the product.

Advantageously, when the element forming spatula is in housed position, the part in relief of the element forming spatula and the screwing surface in relief of the neck form a continuous thread intended to cooperate with the screwing surface of the skirt to allow the closure of the neck by screwing the stopper.

It can then be understood that the element forming spatula when it is in housed position is integrated into the side wall of the container up to the upper end of the neck in such a way that it does not hinder the closure of the container.

In other words, the part in relief of the element forming spatula forms a portion of the thread which comprises a continuous extension of the thread of the container.

It can also be understood that when the stopper is screwed, the screwing means of the container cooperate with the portion of thread of the element forming spatula in such a way that, in this position, said element forming spatula is retained by the stopper and by the side wall.

According to another embodiment, when the element forming spatula is in housed position, the part in relief of the element forming spatula and the screwing surface in relief of the neck form a continuous ramp intended to cooperate with the screwing surface of the skirt to allow the closure of the neck by screwing the stopper.

In this embodiment, the inner surface of the skirt of the stopper is equipped with at least one catch capable of cooperating with at least one ramp located on the neck of the container.

The part in relief of the element forming spatula forms a ramp portion which comprises a continuous extension of a ramp of the neck.

It can therefore also be understood that when the stopper is screwed, the screwing means of the container cooperate with the ramp portion of the element forming spatula in such a way that said element is retained not only by the side wall but also by the stopper.

Advantageously, the container also includes an outer wall surrounding said side wall.

Thus, in a preferential manner, the element forming spatula is located between the side wall and the outer wall.

It is well understood that an additional outer wall allows still better conservation of the element forming spatula in a clean space isolated from outside contamination.

BRIEF DESCRIPTION OF THE DRAWINGS

The invention and its advantages will be more readily understood on reading the following detailed description of the embodiments given as non-restrictive examples. The description refers to the accompanying drawings, on which.

DETAILED DESCRIPTION OF THE INVENTION

Preferably, the container is intended to accommodate cosmetic products of cream, gel, make-up powder and body care type or any other product used in cosmetics. However, this does not comprise a limitation and it is quite conceivable to use the container according to the invention for different products or in domains other than cosmetics such as the pharmacy or the culinary domain.

In reference to FIGS. 1 to 6, a description of a first embodiment of the invention will first of all be given.

The container according to the invention is intended to contain products of pasty, viscous or powdery types.

Figure 1:
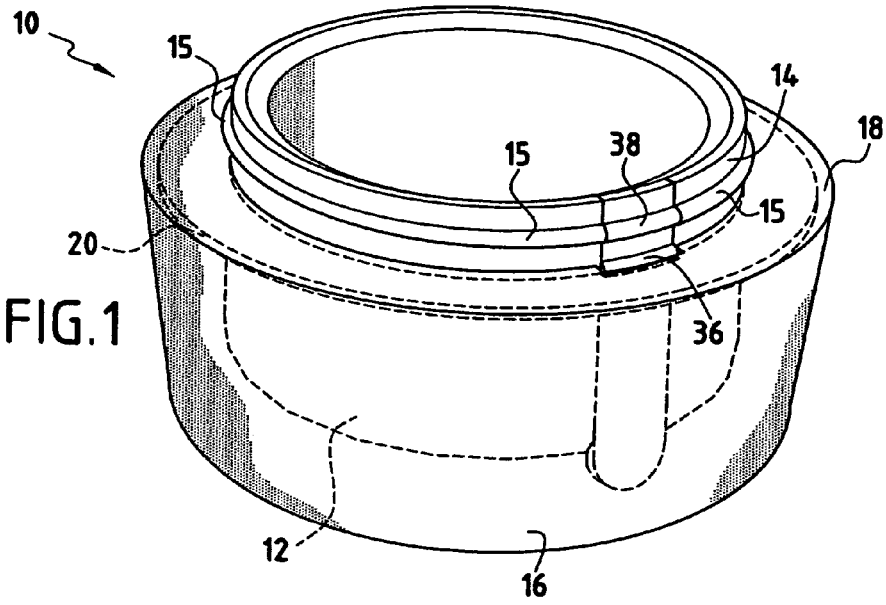
FIG. 1 is a general perspective view of the container equipped with an outer wall and the element forming spatula in housed position according to a first embodiment of the invention.

FIG. 1 shows a container 10 according to the invention of a general cylindrical shape of circular section extending in a longitudinal direction (vertical on FIG. 1) and including a side wall 12 of a substantially cylindrical shape of circular section and a neck 14 also of a substantially cylindrical shape located at the upper end of the side wall 12.

The side wall 12 defines with a bottom 13 a space 13' intended to accommodate the product or the substance.

Figure 14:
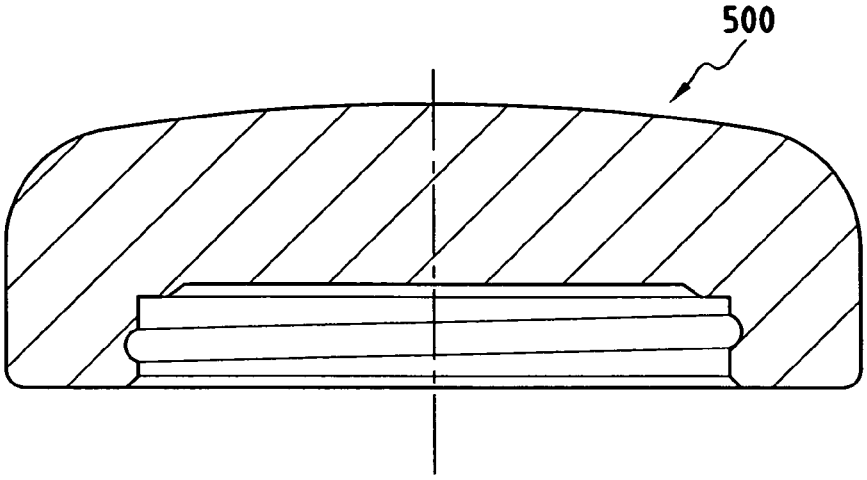
FIG. 14 is a cross-sectional view of a stopper according to the first embodiment of the invention having a threaded skirt.

On its outer periphery, the neck 14 includes a thread 15 intended to allow the screwing of a stopper to allow the screwing of a stopper 500 shown in FIG. 14, itself including an complementary thread on the inner face of its peripheral skirt.

The container 10 also includes an outer wall 16 of a substantially cylindrical shape of circular section the diameter of which is greater than that of the side wall of the container 12 in such a manner that the outer wall 16 surrounds the side wall 12 so as to form a free space between the side wall 12 and the outer wall 16.

The outer wall 16 preferably includes a bottom (not shown here) and an upper annular edge 18 orthogonal to the longitudinal direction of the container 10.

Preferably, to achieve the assembly between the outer wall 16 and the container 10, the bottom of the outer wall 16 is welded with the wall of the bottom 13 of the container 10.

As can be seen on FIG. 1, the upper edge 18 is located under the neck 14 of the container 10 in such a way that the lower end of the skirt of the stopper is capable of making contact with this upper edge 18 when the stopper is in screwed position.

Figure 5:
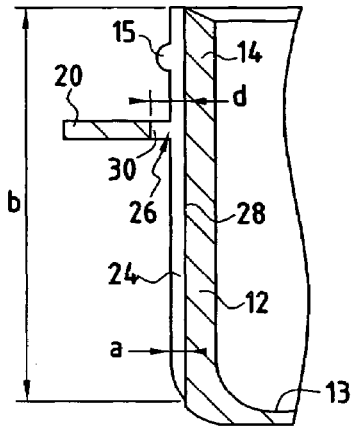
FIG. 5 is a partial cross-sectional side view through V-V of the first embodiment of the container showing the slot.
Figure 4:
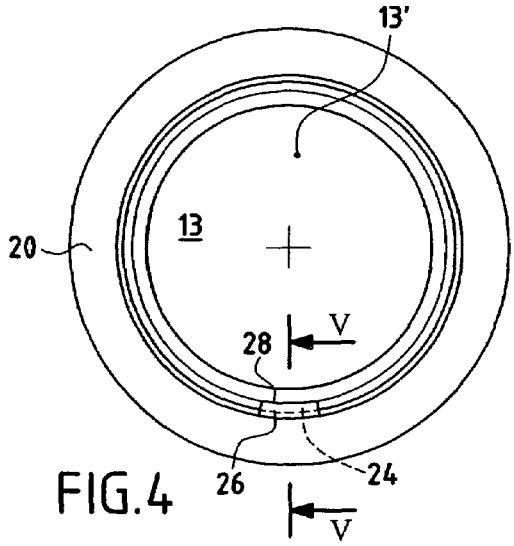
FIG. 4 is a top view of the first embodiment of the container without the element forming spatula.
Figure 6:
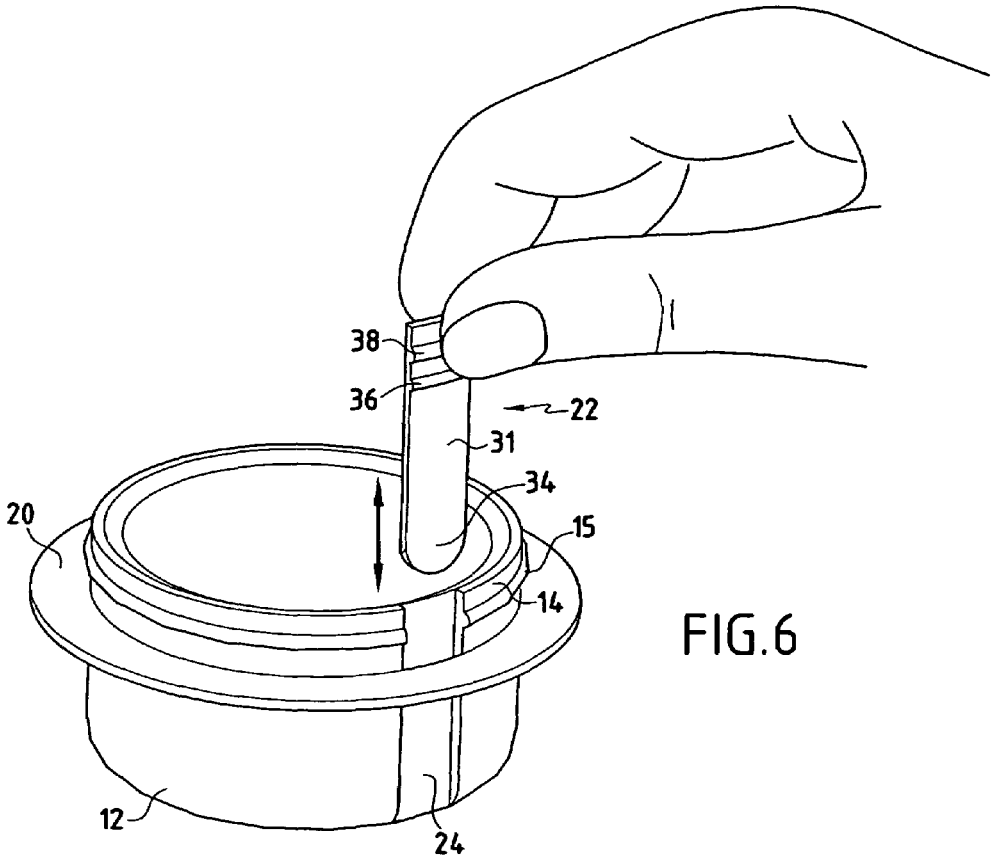
FIG. 6 is a perspective view of the first embodiment of the container according to the invention showing the element forming spatula outside of the container.

Preferably, the upper edge 18 of the outer wall bears on an annular collar referenced 20 on FIGS. 4, 5 and 6.

In another variant not shown here, the annular collar 20 comprises the upper edge of the outer wall 16.

This collar is disposed around the side wall 12 of the container 10 orthogonally to the longitudinal direction of said container.

As can be seen on FIGS. 4, 5 and 6, the side wall 12 of the container 10 also includes means for housing an element forming spatula 22 which preferably is in the form of a slot 24.

This slot 24 extends preferably along the longitudinal direction of the container 10 over the complete height of the side wall 12 and of the neck 14.

As can be seen on FIG. 6, the thread 15 of the neck 14 is locally interrupted by the slot 24.

Preferably, the dimensions of the slot, that is its depth a and its width b, are substantially equal or slightly greater than the respective thickness and width of the element forming spatula 22 so that the outer surface 31 of the element forming spatula 22 lies flush with the side wall 12 in the housed position shown on FIG. 1.

It is therefore understood, by means of FIGS. 4 and 5, that the presence of the slot 24 delimits a notch 26 between the collar 20 and the bottom 28 of the slot.

If the side wall 12 is too thin to be able to make a slot the depth of which is substantially equal to the thickness of the element forming spatula, a cutout 30 is made in the complete thickness of the annular collar so that the distance d between the collar 20 and the bottom 28 of the slot 24 is at least equal to the thickness of the element forming spatula 22.

As an example, FIG. 1 shows the element forming spatula 22 in housed position.

The element forming spatula 22 can be better seen on FIGS. 2 and 3 to which reference will now be made.

Preferably, the element forming spatula 22 presents the form of a plate presenting an outer face 31 extending in a longitudinal direction and including at its upper end a flat portion 32 orthogonal to the longitudinal direction.

Said element also includes at its lower end a rounded portion 34 intended to remove the product from the space 13' of the container then to apply it to the body.

It is understood that the element forming spatula 22 can present a slight curvature in order to ideally cooperate with the curvature of the outer face of the side wall 12 of the container when said element is in housed position.

Figure 2:
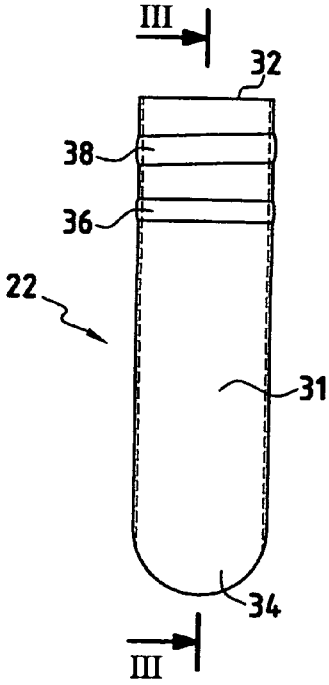
FIG. 2 is a front view of the element forming spatula capable of being housed in the container according to a first embodiment of the invention.
Figure 3:
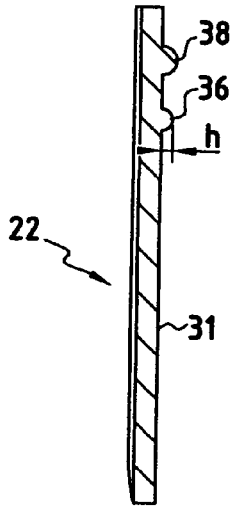
FIG. 3 is a cross-sectional view of the element forming spatula of FIG. 2 through III-III shown on FIG. 2.

As can be seen on FIG. 2, the upper end of the element forming spatula 22 includes also on its outer face 31 means forming a stop preferably in the form of a catch 36 which extends in the transverse direction of said element forming spatula 22 and which has a height h measured from the outer face 31.

The height h of the catch 36 is such that the thickness of the element forming spatula 22 at the location of the catch 36 is at least equal to the distance d measured between the radially outer face of the notch 26 and the bottom 28 of the slot 24 so that in housed position, the catch 36 bears against the upper face of the collar 20 to allow the correct positioning of the element forming spatula 22 and also to block said element in translation to prevent it from failing off the container.

The upper end of the element forming spatula also includes a part in relief on its outer face 31 in the form of a protrusion 38 which extends substantially transversally in relation to the element forming spatula.

Preferably, said protrusion 38 is slightly inclined in relation to the transverse direction of said element 22 so that, in housed position, the protrusion 38 substantially corresponds to the portion of the thread which is missing from the collar due to the presence of the slot 24.

In other words, the protrusion 38 prolongs the thread 15 and the thread 15 and protrusion 38 assembly is capable of forming a continuous thread to cooperate with the inner thread of the skirt of the stopper to enable the closure of the container 10 by screwing.

In addition, as can be seen on FIG. 6, the part in relief of the element forming spatula is capable of facilitating the grip of said element.

According to a variant, the container includes a thick side wall but does not include an additional outer wall.

Preferably, this thick wall presents a thickness substantially equal to the width of the collar 20.

In this case, the means for housing the element forming spatula include a channel formed in the side wall of the container.

Preferably, this channel presents a section of a width substantially equal to or slightly greater than the thickness of the element forming spatula 22 and extends along the longitudinal direction of the container 10 so as to form a sheath for the element forming spatula 22.

A second embodiment of the container according to the invention will now be described in reference to FIGS. 7 to 13.

The elements described in this part which have functions the same as those of the elements described in the first embodiment have the same numerical references as the elements of the first embodiment, multiplied by ten.

Figure 7:
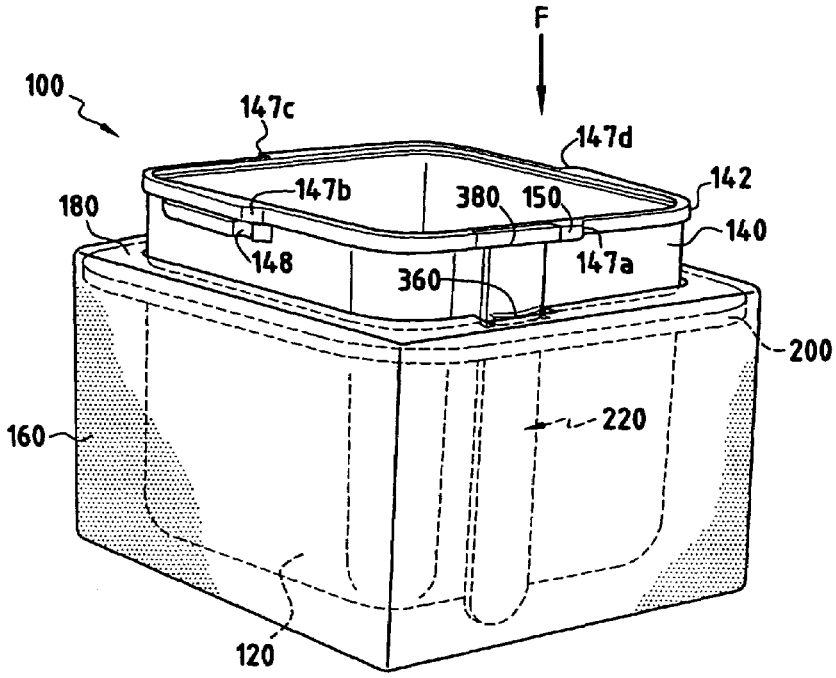
FIG. 7 is a general perspective view of the container equipped with an outer wall and the element forming spatula in housed position according to a second embodiment of the invention.
Figure 10:
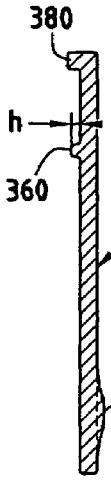
FIG. 10 is a cross-sectional side view, through X-X shown on FIG. 9, of the element forming spatula.
Figure 9:
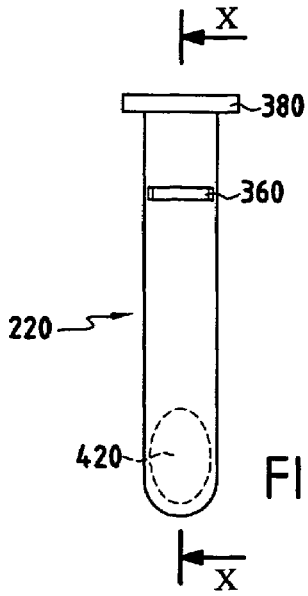
FIG. 9 is a front view of the element forming spatula capable of being housed in the side wall of the container according to the second embodiment of the invention.
Figure 8:
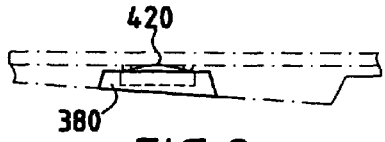
FIG. 8 is a projected view on arrow F shown on FIG. 7 of the top of the container according to the second embodiment of the invention.
Figure 15:
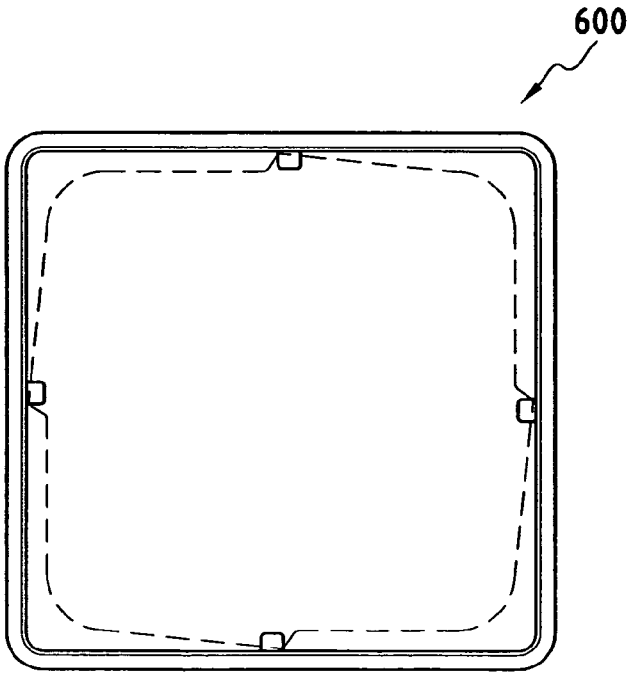
FIG. 15 is a bottom view of a stopper according to the second embodiment of the invention having a threaded skirt.

FIG. 7 shows a container 100 according to the invention including a neck 140 with a substantially rectangular section capable of being closed by a stopper 600 also presenting a rectangular shape as shown in FIG. 15.

As an example, American patent U.S. Pat. No. 6,318,578 describes a container with a non-circular neck capable of being closed by a stopper the screwing means of which also have a rectangular arrangement.

The neck 140 includes a ring 142 with a non-circular contour presenting diametrically opposite notches 147*a*, 147*b*, 147*c* and 147*d* for the passage of catches provided on the lower face of the skirt of the stopper. Said skirt also presents a non-circular section.

Figure 13:
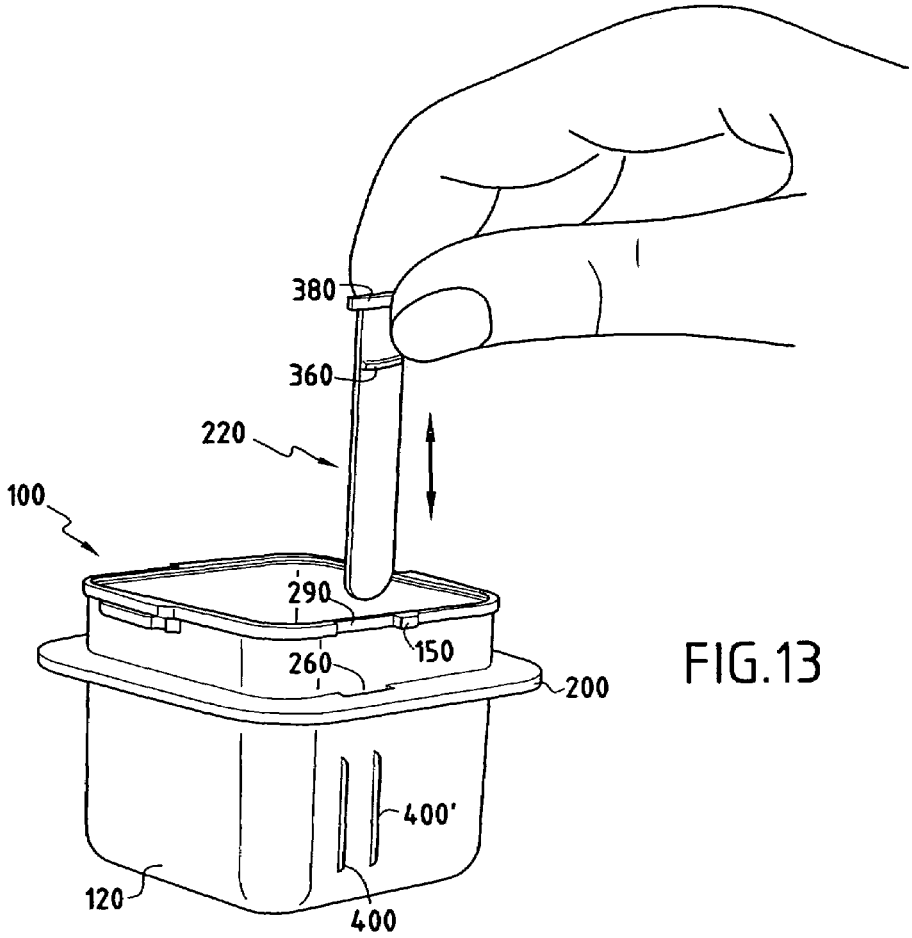
FIG. 13 is a general perspective view of the container according to the second embodiment showing the element forming spatula outside of the container.

In addition, the ring 142 presents at least one ramp 150 under which a catch of the stopper can be disposed in order to retain the stopper in translation in the longitudinal direction of the container (vertical on FIGS. 7 and 13).

Preferably, the neck 140 also includes locking means 148 intended to block the catches of the stopper in order to block the rotation of the stopper when it is in screwed position.

The technical characteristics of the container with non-circular neck according to the invention are similar to those of the container with circular neck described previously in relation to FIGS. 1 to 5.

The container 100 according to the invention also includes a side wall 120, an outer wall 160, a neck 140 and a collar 200.

In this embodiment, the ring 142 located at the upper end of the neck 140 includes a cutout 290 made preferably in a ramp 150 as can be seen on FIG. 13.

The means for housing the element forming spatula 220 include a notch 260 made in the collar 200 substantially under the cutout 290, that is in the extension of the cutout 290 in longitudinal direction.

Figure 12:
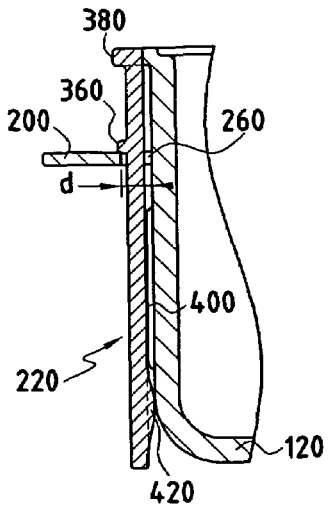
FIG. 12 is a partial cross-sectional side view, through XII-XII shown on FIG. 11, representing the element forming spatula in housed position in the container according to the second embodiment of the container.
Figure 11:
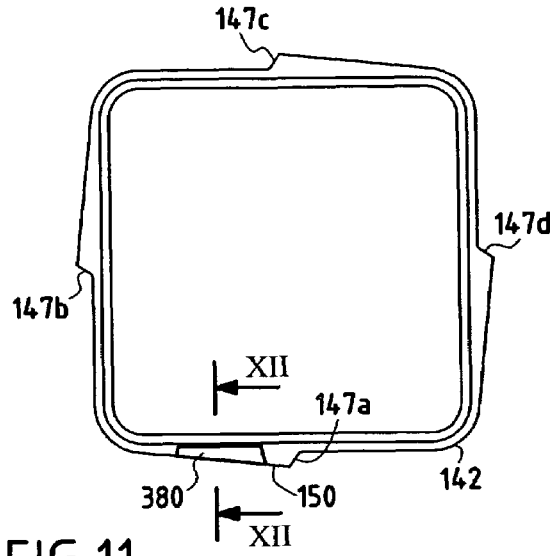
FIG. 11 is a top view of the second embodiment of the container.

This notch 260 can in particular be seen on FIGS. 12 and 13.

Naturally, this notch 260 is dimensioned so that it can accommodate the element forming spatula 220.

As can be seen on FIGS. 9 to 12, the element forming spatula 220 also presents a stop 360 capable of cooperating with the upper face of the collar 200 in order to correctly position said element and to block it in translation to prevent it from sliding out of the container 100.

The element forming spatula 220 also includes at its upper end a part in relief 380 presenting a form such that, when the element forming spatula is in housed position, the part in relief 380 is housed almost entirely in the cutout 290.

It is therefore understood that the part in relief 380 fills the cutout 290 in order to reform the ramp 150 in a continuous manner.

Thus, when the element forming spatula is in housed position, the container has a screwing surface of the neck 140 capable of accommodating the screwing means of the stopper to allow the closure of the container.

The lower end of the element forming spatula 220 optionally includes a rounded edge and an overthickness 420 with an egg-shaped contour intended in particular to facilitate the removal of the product from the container and/or the application of the product.

As can be seen on FIG. 12, the overthickness 420 could be located on the face of the element forming spatula opposite to that on which the part in relief 380 is located.

The means for housing the element forming spatula 220 could also include two longitudinal swells 400, 400' located on the outer face of the side wall 120 to guide the element forming spatula 220.

The longitudinal swells 400, 400' could extend in the longitudinal direction of the container 100 and, as can be seen for example on FIG. 12, they guide in translation the egg-shaped overthickness 420 when the element forming spatula 220 is in housed position.

For this purpose, the spacing between the longitudinal swells 400, 400' may be slightly lower than the width of the element forming spatula 220.

According to a variant not shown here, the container with non-circular neck can also include a thick side wall without outer wall. In this case, the side wall includes a channel for housing the element forming spatula.

In a non-restrictive manner, the end of the element forming spatula opposite the part in relief 360 is capable of including a comb, a brush, a portion forming sponge, or a flat paddle.

In addition, it can also be conceived, without leaving the scope of the invention, that the stop means include a catch located on the upper edge of the element forming spatula so that, in housed position, this catch makes contact with the upper edge of the neck to position said element and to block it in translation in order to prevent said element from falling off the container.

What is claimed is:

1. Container provided with an element forming spatula having an end provided with a part in relief, wherein:

said container comprises:

a stopper comprising a peripheral skirt having a screwing surface and a lower end;

a bottom wall;

a side wall having a first end opposite said bottom wall, an outer face, and having means for housing in a removable manner said element forming spatula; and a neck located at the first end of the side wall, comprising a screwing surface in relief and capable of being closed by said stopper surrounding the neck, said screwing surface in relief being capable of cooperating with said screwing surface of said skirt for closing the stopper by screwing, wherein the screwing surface in relief of the neck has an interruption and wherein said part in relief of said element forming spatula is adapted to cooperate with said interruption so that the screwing surface in relief of the neck together with the part in relief of said element forming spatula are able to form a continuous portion intended to cooperate with the screwing surface of the skirt to allow the closure of the neck by screwing the stopper.

2. The container according to claim 1, further comprising a peripheral collar extending orthogonally to a longitudinal direction of the side wall and presenting an upper face so that, in screwed position, the lower end of the skirt of the stopper bears on the upper face of the said collar.

3. The container according to claim 1, further including stop means for positioning said element in relation to said side wall.

4. The container according to claim 1, wherein the element forming spatula includes a catch capable of cooperating with the upper face of the collar for positioning the element forming spatula.

5. The container according to claim 1, wherein the means for housing the element forming spatula further include a slot formed in the outer face of the side wall of the container.

6. The container according to claim 5, wherein the dimensions of the slot are such that when the element forming spatula is housed in the slot, one face of said element forming spatula lies flush with the outer face of the side wall of the container.

7. The container according to claim 1, wherein the means for housing the element forming spatula further include a channel formed in the side wall of the container.

8. The container according to claim 1, wherein the means for housing the element forming spatula further include a notch located between the collar and the side wall.

9. The container according to claim 1, wherein the part in relief of the element forming spatula is capable of facilitating the grip of said element.

10. The container according to claim 1, wherein, when the element forming spatula is in housed position, the part in relief of the element forming spatula and the screwing surface in relief of the neck form a continuous thread for cooperating with the screwing surface of the skirt for closing the neck by screwing the stopper.

11. The container according to claim 1, wherein, when the element forming spatula is in housed position, the part in relief of the element forming spatula and the screwing surface in relief of the neck form a continuous ramp for cooperating with the screwing surface of the skirt for closing the neck by screwing the stopper.

12. Container provided with an element forming spatula having an end provided with a part in relief, wherein:

said container comprises:

a stopper comprising a peripheral skirt having a screwing surface and a lower end;

a bottom wall;

a side wall having a first end opposite said bottom wall, an outer face, and having means for housing in a removable manner said element forming spatula, said element forming spatula extending along the side wall; and a neck located at the first end of the side wall, comprising a screwing surface in relief and capable of cooperating with said screwing surface of said skirt for closing the stopper by screwing, wherein the screwing surface in relief of the neck has an interruption and wherein said part in relief of said element forming spatula is adapted to cooperate with said interruption so that the screwing surface in relief of the neck together with the part in relief of said element forming spatula are able to form a continuous portion intended to cooperate with the screwing surface of the skirt to allow the closure of the neck by screwing the stopper.

* * * * *